United States Patent [19]

Mannetje et al.

[11] Patent Number: 4,941,967

[45] Date of Patent: Jul. 17, 1990

[54] PROCESS FOR RE-REFINING SPENT LUBEOILS

[75] Inventors: Leonardus M. M. Mannetje, Permata Hijau, Indonesia; Ashok S. Laghate, Zoetermeer, Netherlands

[73] Assignee: Kinetics Technology International B.V., Zoetermeer, Netherlands

[21] Appl. No.: 9,085

[22] Filed: Jan. 27, 1987

Related U.S. Application Data

[63] Continuation of Ser. No. 674,315, Nov. 20, 1984, abandoned.

[30] Foreign Application Priority Data

Nov. 23, 1983 [NL] Netherlands ..... 8304023

[51] Int. Cl.[5] ..... C10M 11/00

[52] U.S. Cl. ..... 208/184; 208/181; 208/264; 208/355; 208/179; 208/360

[58] Field of Search ..... 208/181, 184, 264, 355, 208/88, 92, 93, 94, 131, 354, 360

[56] References Cited

U.S. PATENT DOCUMENTS

| | | | |
|---|---|---|---|
| 2,062,933 | 12/1936 | Renfrew | 208/184 |
| 2,076,498 | 4/1937 | Farwell | 208/184 |
| 2,095,470 | 10/1937 | Foley | 208/184 |
| 3,402,124 | 9/1968 | Jones | 208/355 |
| 3,625,881 | 12/1971 | Chambers | 208/184 |
| 3,702,817 | 11/1972 | Cummins et al. | 208/264 |
| 3,852,207 | 12/1974 | Stangeland et al. | 208/264 |
| 3,923,643 | 12/1975 | Lewis | 208/179 |
| 4,028,226 | 6/1977 | Forsberg | 208/180 |
| 4,247,389 | 1/1981 | Johnson | 208/181 |
| 4,342,645 | 8/1982 | Fletcher et al. | 208/184 |
| 4,360,420 | 11/1982 | Fletcher et al. | 208/184 |
| 4,431,524 | 2/1984 | Norman | 208/181 |
| 4,432,865 | 2/1984 | Norman | 208/181 |
| 4,606,816 | 8/1986 | Harandi | 208/355 |

FOREIGN PATENT DOCUMENTS

| | | | |
|---|---|---|---|
| 3042094 | 5/1981 | Fed. Rep. of Germany | 208/184 |
| 166060 | 10/1977 | Netherlands | 208/184 |
| 7711298 | 4/1979 | Netherlands | 208/184 |
| 2068998 | 8/1981 | United Kingdom | 208/181 |

*Primary Examiner*—Helane Myers
*Attorney, Agent, or Firm*—Ladas & Parry

[57] ABSTRACT

Process for re-refining spent lubeoils, wherein a lubeoil freed from water and sludge forming impurities is subjected to a pre-destillation at reduced pressure and with a short residence time of the oil in the distillation column and is subsequently subjected to film evaporation under vacuum, in one or more wiped-film evaporators wherein the overhead product obtained with the film evaporator is subjected to an after-treatment after condensation and the heavy bottom product (residue product) of at least one film evaporator is at least partially recycled to the entrance of said film evaporator.

11 Claims, 1 Drawing Sheet

PROCESS FOR RE-REFINING SPENT LUBEOILS

This is a continuation of co-pending application Ser. No. 674,315 filed on Nov. 20, 1984 now abandoned.

The invention relates to a process for re-refining spent lubeoils, wherein a spent lubeoil, freed from water and sludge forming impurities is subjected to a pre-distillation at reduced pressure and with a short residence time of the oil in the distillation column and is subsequently subjected to film evaporation under vacuum, the liquid film being maintained in turbulent motion by wiping and the overhead product obtained with the film evaporation is subjected to an after-treatment after condensation.

Dutch Pat. No. 166060 shows a process wherein spent lubeoil, after a pre-distillation under a pressure of 3.33–9.33 kPa, wherein light components are separated, is subjected to film evaporation in two wiped film evaporators in series, which are operated at a pressure in the order of 13.3–266 Pa. The bottom product of the first film evaporator is fed as feed material to the second one. The instant invention provides a considerable saving of the cost of installation and of operation in comparison to the process of Dutch Pat. No. 166060.

The process of Dutch Pat. No. 166060 makes it possible to use a catalytic treatment with hydrogen as an after-treatment, as is known per se from "Hydrocarbon Processing" 1973 (9), 134 and thus provides products of good quality which are suitable as lubeoil bases and which can easily be adapted to variations in the composition of the feed.

It has now been found that during the film evaporation which takes place under comparable conditions of temperature and pressure, an overhead product of generally better quality may be obtained, which cannot only be converted into an excellent lubeoil base by means of a current after-treatment, e.g. a catalytic treatment with hydrogen according to the above mentioned Hydrocarbon Processing treatment l.c., but which can also be used as feed for modern catalytic cracking processes in the fluidized phase (FCC-processes: vide e.g. Oil and Gas Journal, May 17, 1976), if the film evaporation takes place in one or more wiped film evaporators and the heavy bottom product (residue product) of at least one film evaporator is at least partially recirculated to the entrance of the film evaporator.

U.S. Pat. No. 4,360,420 describes a process for re-refining spent lubeoils, wherein use is made of a wiped film evaporator, and a fraction which is separated in the film evaporator is partially recirculated. In contradiction to the process of the invention however, this is a light fraction which is separated as vapour in the film evaporator.

It is not quite clear why the instant invention provides a product of better quality in equally good yield. A possible explanation is that as a result of recycling the bottom product the composition of the total material which enters the film evaporator is changed to such an extent that the material moistens the wall of the film evaporator more effectively and therefore causes a better heat transfer and evaporation. Except when treating spent heavy lubeoil, one can generally obtain the above mentioned results with a single wiped film evaporator.

In accordance with the invention, the process can also be used for re-fining spent heavy lubeoils by using two wiped film evaporators, the bottom product of the first evaporator being used as feed for the second one and the bottom product of the second film evaporator being at least partially recirculated to the entrance of said film evaporator.

The amount of bottom product which is recirculated to the entrance of the film evaporator generally varies between 5 and 30% of the total amount of overhead product, depending on the quality of the spent lubeoil which is used as feed material. For heavy lubeoil the percentage is preferably between 5 and 15%. For the other lighter, spent lubeoils it is preferably 10–25%. With such a degree of recirculation the result is optimum.

The overhead fraction coming from the wiped film evaporator(s), is preferably condensed at a temperature of 150°–250° C., whereafter the condensate is subjected to a "hot-soak". The hot soak is carried out in an apparatus wherein the condensed overhead fraction from the wiped film evaporate(s), is kept at an elevated temperature between 150°–250° C. and is provided a residence time of 1–30 hours. During the hot soak certain impurities present in the condensed overhead fraction react and settle out as sludge and are removed from the bottom of the apparatus. The condensate from the hot soak undergoes thereby an improvement in its quality which has a favorable influence in the after-treatment e.g. the catalytic treatment with hydrogen according to Hydrocarbon Processing and the quality of the lubricating base oils herewith obtained. The product of the "hot-soak" is furthermore also suitable as feed for a FCC treatment. Preferably, during the hot-soak the condensate is kept at the condensation temperature as this has the best effect.

A hot-soak of less than 1h does not result in an improvement which is of practical significance and a hot-soak of more than 30 hours does not give a further improvement of quality. The optimum duration within the range of 1–30 hours depends on the quality of the used spent lubeoil.

If the product coming from the "hot-soak" is subjected to a catalytic treatment with hydrogen, the "hot-soak" product is preferably combined with the light components which are separated during the pre-distillation under reduced pressure. The light components form a gas oil of bad quality, which if they are hydrogenated together with the hot-soak product provides a final product from which, by fractionated distillation, a diesel oil having excellent properties can be recovered in addition to a lubeoil base with good properties, a product which cannot be obtained from the gas oil of the pre-distillation.

BRIEF DESCRIPTION OF THE DRAWINGS

The invention can be more completely understood by reference to the accompanying drawings, in which.

In these figures equivalent components are indicated with the same reference numerals.

Figure 1:
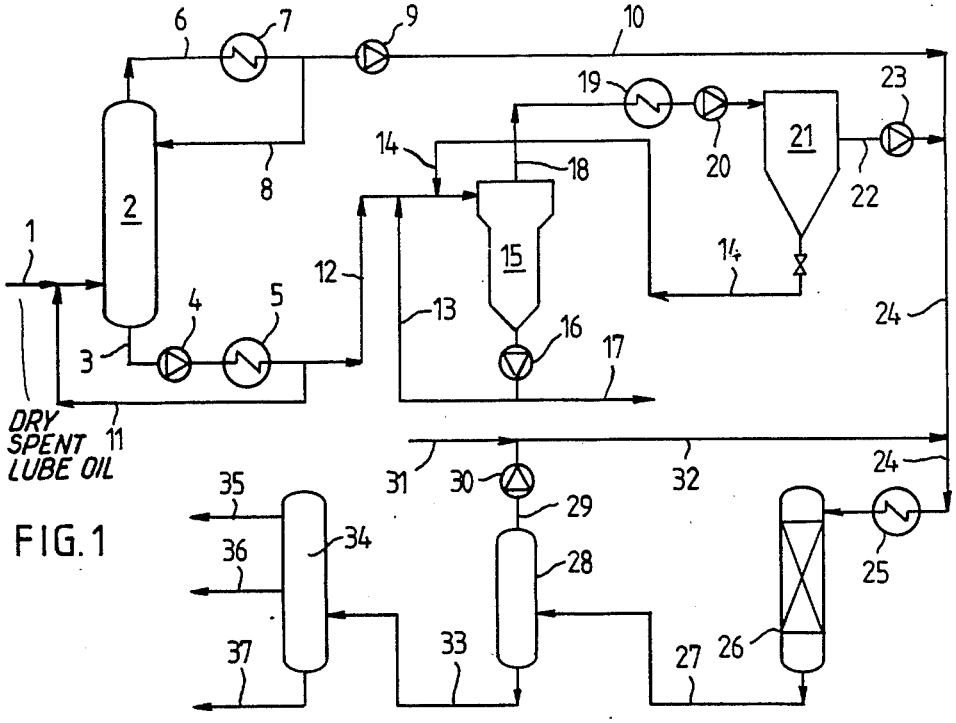
FIG. 1 is a schematic flow sheet of a preferred embodiment of the invention.
Figure 2:
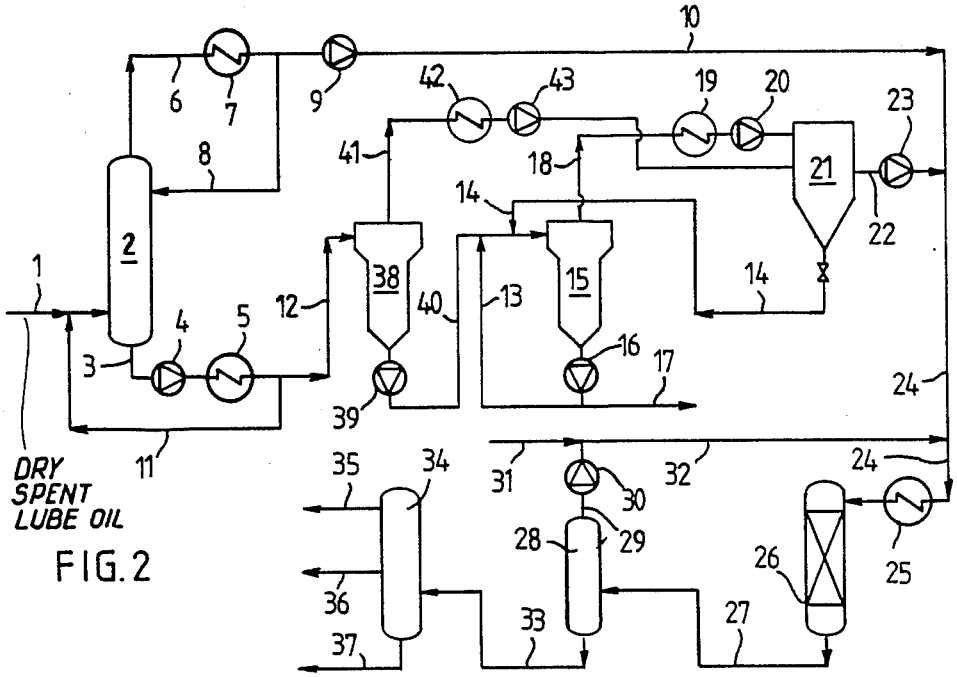
FIG. 2 is a second embodiment of the invention wherein two film evaporators are used.

The invention is elucidated in the following examples. Example I is described with the aid of FIG. 1. Example II is described with the aid of FIG. 2.

In both examples spent lubeoil is used which first has been freed from sludge forming impurities and water and light components (gasoline by which the lubeoil is contaminated) e.g. by filtration in a mechanical or mechanical/magnetic filter and flash evaporation, in the manner described in Dutch Pat. No. 166,060.

EXAMPLE I

Spent lubeoil freed from sludge-forming impurities and from water and light components is fed via conduit 1 to a pre-distillation column 2, together with an amount of the bottoms from this pre-distillation column which is recycled through conduit 11. In the pre-distillation column 2, under reduced pressure, a gasoil of low grade is separated by fractionation from the lubeoil. The gasoil vapors escape through conduit 6 are condensed in heat exchanger 7 and are partly recycled as a reflux through conduit 8, the rest being discharged via line 10 by means of pump 9 and further used as described below. Spent lubeoil freed from gasoil leaves colum 2 as a bottoms stream through conduit 3, and is pressed through a heat exchanger 5 by means of a pump 4, where this stream is preheated. Part of the preheated bottoms stream is recycled through conduit 11 and mixed with the dry spent lubeoil in conduit 1 as previously described. The remainder of the pre-heated bottoms stream flows through conduit 12 to a wiped film evaporator 15. The bottoms stream before arriving in the film evaporator 15 is mixed with part of the bottom product coming from the film evaporator which is cycled in conduit 13 by means of pump 16. The remainder of the bottom product from the film evaporator 15 is discharged through conduit 17.

A heavy fraction, described below, is mixed with the bottoms stream in conduit 12 which is fed as a blow-off (drain) stream from a hot-soak via conduit 14.

In the film evaporator, which operates under vacuum, light lubeoil components are evaporated. These vapors escape through conduit 18 and are condensed in the heat exchanger 19, the temperature being maintained as high as possible. The condensate is pumped by pump 20 into a vessel 21, where this condensate undergoes a hot-soak. In this hot-soak treatment impurities present in the condensate are separated as a heavy fraction; this heavy fraction is recycled as a blow off (drain) stream via conduit 14 and as previously described, is mixed with the preheated bottoms stream in conduit 12.

The condensate in vessel 21 from which impurities have been separated as a heavy fraction, is discharged after the hot-soak via conduit 22 and pump 23, is mixed with the gasoil fraction which was formed in the pre-distillation (column 2) and discharged via line 10 by means of pump 9 as described above, and, after having been mixed with hydrogen, is passed via conduit 24 and heat exchanger 25 to a reactor 26 filled with hydrogenation catalyst, where the mixture is hydrogenated. The product stream from the hydrogenation reactor is passed through conduit 27 to a separator 28 in which the residual hydrogen is separated and is discharged through conduit 29 in order that after increasing the pressure in compressor 30 and mixing with replenishing (make up) hydrogen which is fed through conduit 31, it is recycled via conduit 32 and is mixed with the mixture of hydrocarbons fed through conduit 24.

The hydrogenated hydrocarbon mixture is discharged from the bottom of the separator 28 and is passed via conduit 33 to a fractionation column 34, in which this mixture of hydrocarbons is separated into a diesel oil fraction 35 which leaves the column at the top, a light lubricating base oil fraction 36 leaving the column as a middle fraction and a heavy lubricating base oil fraction 37.

The conditions applied and results achieved are listed in the following table.

EXAMPLE II

Just as in the process of example I spent lubeoil freed sludge-forming impurities and from water and light components is fed via conduit 1 to a pre-distillation column 2, together with an amount of the bottoms from this pre-distillation column which is recycled through conduit 11. In the pre-distillation column 2, under reduced pressure, a low grade gasoil is separated by fractionation, from the lubeoil. The gasoil vapors escape through conduit 6, are condensed in heat exchanger 7 and are partly recycled as a reflux through conduit 8 the rest being discharged via line 10 by means of pump 9 and used as described below. Spent lubeoil freed from gasoil leaves the column 2 as a bottoms stream through conduit 3 and is pressed through a heat exchanger 5 by means of a pump 4 where this stream is preheated. Part of the preheated bottoms stream is recycled through conduit 11 and mixed with dry spent lubeoil in conduit 1, as previously described. The residue of the preheated bottoms stream is passed through conduit 12 to a wiped film evaporator 38.

In this first, wiped film evaporator 38, which operates under the lighter components of the lubeoil are evaporated; the vapors escape via conduit 41 and condensate in the heat exchanger 42, whereupon the condensate is pumped to the hot-soak tank 21 by means of pump 43. The bottom product from this first, wiped film evaporator 42 is pumped to a second wiped film evaporator 15 by pump 39 and via conduit 40.

Before it enters the film evaporator 15, this bottom product of the first film evaporator 38 is mixed with an amount of bottom product from the second wiped film evaporator 15 and also with a blow-off (drain) stream from the hot-soak tank 21. The bottom product from the film evaporator 15 which is recycled in this way, is only part of the total bottom product from the second film evaporator 15. This total bottom product is pumped-off from the bottom of the film evaporator 15 by pump 16; part is recycled via conduit 13 to conduit 40 and the residue is discharged as such via conduit 17.

In the second wiped film evaporator 15, which also operates under vacuum, the heavier lubeoil components are evaporated. They escape at the top via conduit 18 and condense in the heat exchanger 19, whereupon they are transported to the hot-soak tank 21 by means of pump 20.

The light and heavy lubeoil components undergo a hot soak in the hot-soak tank 21, by which heavy impurities are separated and are passed as a blow-off (drain) stream via conduit 14 to the second wiped film evaporator 15. The temperature in the hot-soak tank 21 is maintained at a value close to the condensation temperature of the heat exchangers 42 and 19. The impurities which are separated during the hot-soak and are discharged as a blow-off (drain) stream, ultimately leave the system as part of the residue product 17.

The condensate in vessel 21 from which impurities have been separated as a heavy fraction, is discharged after the hot-soak via conduit 22 and pump 23, is mixed with the gasoil fraction which was formed in the pre-distillation (column 2) and discharged via line 10 by means of pump 9 as described above and, after having been mixed with hydrogen, is passed via conduit 24 and heat exchanger 25 to a reactor 26 filled with hydrogenating catalyst, where the mixture is hydrogenated. The product stream from the hydrogenation reactor 26 is passed through conduit 27 to a separator 28, in which the residual hydrogen is separated which hydrogen is discharged through conduit 29 and after increasing the pressure in compressor 30 and mixing with replenishing (make up) hydrogen which is fed through conduit 31, is recycled via conduit 32 and is mixed with the mixture of hydrocarbons fed through conduit 24.

The hydrogenated hydrocarbon mixture is discharged from the bottom of the separator 28 and is passed to a fractionation column 34 via conduit 33, in which this mixture of hydrocarbons is separated into a diesel oil fraction 35 which leaves the column at the top, a light lubricating base oil fraction 36 which leaves the column as a middle fraction and a heavy lubricating base oil fraction 37.

The conditions applied and the results achieved are listed in the following table.

TABLE

| | Example I | Example II |
|---|---|---|
| Temperature in predistillation column 2 | 220° C. | 220° C. |
| pressure in predistillation column 2 | 2 kPa | 2 kPa |
| Temperature in wiped film evaporator 38 | — | 320° C. |
| Pressure in wiped film evaporator 38 | — | 1.5 kPa |
| Temperature in wiped film evaporator 15 | 345° C. | 345° C. |
| Pressure in wiped film evaporator 15 | 200 Pa | 150 Pa |
| Temperature in hot soak tank 21 | 180° C. | ? |
| Residence time in hot soak | 24 h | 26 h |
| Temperature in hydrotreater 26 | 320° C. | 320° C. |
| Pressure in hydrotreater | 6000 kPa | 6000 kPa |
| Temperature in fractionation column 34 | 200° C. | 200° C. |
| Pressure in fractionation column 34 | 3 kPa | 3 kPa |
| Feed rate of dry spent lubeoil | 5000 kg/h | 3000 kg/h |
| Gasoil fraction from predistillation column | 410 kg/h | 120 kg/h |
| Amount of condensate (free from impurities) from hot soak 21 | 4180 kg/h | 2560 kg/h |
| Residue product from wiped film evaporator 17 | 310 kg/h | 280 kg/h |
| Residue recycling rate of bottoms from evaporator 13 | 800 kg/h | 200 kg/h |
| Diesel fuel obtained as a product | 520 kg/h | 190 kg/h |
| Total lubricating baseoil product | 4020 kg/h | 2460 kg/h |

We claim:

1. A process for re-refining spent lubeoils, comprising (a) removing water and sludge forming impurities from lubeoil, (b) subjecting the lubeoil to a pre-distillation at reduced pressure and with a short residence time of the oil in the distillation column, (c) subsequently subjecting it to film evaporation under vacuum, the liquid film being maintained in turbulent motion by wiping, (d) subjecting the overhead product obtained with the film evaporation to an after-treatment after condensation, wherein the film evaporation takes place in one or more wiped-film evaporators and a portion of the total heavy bottom product of at least one film evaporator is recirculated to the entrance of the film evaporator.

2. The process, as in claim 1, wherein the after-treatment is a hot soak.

3. The process according to claim 1, wherein one film evaporator is used.

4. The process according to claim 1, wherein two film evaporators are used, the bottom product of the first evaporator being used as feed for the second one and a portion of the bottom product of the second film evaporator being recirculated to the entrance of said film evaporator.

5. The process according to claim 1, whereby in each film evaporator wherein recirculation of bottom product takes place, the recirculation comprises 5–30% recirculation based on the total overhead products.

6. The process according to claim 4, wherein the amount of bottom product which is recirculated corresponds to 10–25% of the total overhead product.

7. The process according to claim 5 wherein the amount of bottom product which is recirculated comprises 5–15% of the total overhead product.

8. The process according to claim 2 comprising condensing the overhead product coming from the film evaporator(s) at a temperature of 150°–250° C., and subjecting the condensate to a hot soak wherein the condensate is maintained between 150° and 250° C. for a period of I1 to 30 hours.

9. The process according to claim 8, wherein the condensate is subjected to a catalytic hydrogenation and a lubeoil base is recovered.

10. The process according to claim 9, wherein the "hot-soak" product is combined with the light components which are separated during the pre-distillation and the mixture is subjected to the catalytic hydrogenation.

11. The process according to claim 8 comprising using the condensate as a feed material for catalytic cracking in the fluidized phase.

* * * * *

UNITED STATES PATENT AND TRADEMARK OFFICE

CERTIFICATE OF CORRECTION

PATENT NO. : 4,941,967

DATED : July 17, 1990

INVENTOR(S) : L. M. M. 't Mannetje et al

It is certified that error appears in the above-identified patent and that said Letters Patent is hereby corrected as shown below:

ON TITLE PAGE: Column 1, Item [75]

Inventors: change "Mannetje" to -- 't Mannetje--

Signed and Sealed this

Fifth Day of November, 1991

*Attest:*

*Attesting Officer*

HARRY F. MANBECK, JR.

*Commissioner of Patents and Trademarks*